US008747190B2

(12) United States Patent
Smith

(10) Patent No.: US 8,747,190 B2
(45) Date of Patent: Jun. 10, 2014

(54) TOOL FOR REMOVING GROUT, MORTAR AND THE LIKE

(76) Inventor: Mark Smith, Leicester, MA (US)

( * ) Notice: Subject to any disclaimer, the term of this patent is extended or adjusted under 35 U.S.C. 154(b) by 385 days.

(21) Appl. No.: 12/798,623

(22) Filed: Apr. 8, 2010

(65) Prior Publication Data

US 2011/0250825 A1 Oct. 13, 2011

(51) Int. Cl.
*B24B 9/06* (2006.01)

(52) U.S. Cl.
USPC ..... 451/259; 451/451; 451/261; 451/406; 451/487; 451/359; 451/456

(58) Field of Classification Search
USPC ..... 451/259, 262, 406, 408, 487, 520, 359, 451/456, 451; 408/67; 30/388–391; 125/3–5, 13.01–15; 83/881
See application file for complete search history.

(56) References Cited

U.S. PATENT DOCUMENTS

| | | | | | |
|---|---|---|---|---|---|
| 897,603 | A | * | 9/1908 | Duncan | 451/456 |
| 1,927,655 | A | * | 9/1933 | Belden et al. | 451/294 |
| 2,189,246 | A | * | 2/1940 | Henry | 451/358 |
| 3,518,819 | A | * | 7/1970 | Morris et al. | 56/344 |
| 4,145,086 | A | * | 3/1979 | Ishihara | 299/15 |
| 4,350,552 | A | | 9/1982 | Bourke | |
| 4,586,211 | A | * | 5/1986 | Phillips | 15/52.1 |
| 4,685,214 | A | * | 8/1987 | Shearon et al. | 30/391 |
| 4,781,556 | A | | 11/1988 | Paul | |
| 4,984,369 | A | | 1/1991 | Flint et al. | |
| 5,020,280 | A | * | 6/1991 | O'Reilly | 451/342 |
| 5,438,757 | A | | 8/1995 | Weschenfelder | |
| 5,651,727 | A | | 7/1997 | Weinstein et al. | |
| 5,885,139 | A | | 3/1999 | Lemieux et al. | |
| 5,988,954 | A | | 11/1999 | Gaskin et al. | |
| 6,023,811 | A | | 2/2000 | Ciarrocchi | |
| 6,110,027 | A | * | 8/2000 | Muller | 451/359 |
| 6,595,196 | B2 | | 7/2003 | Bath | |
| 6,668,463 | B2 | | 12/2003 | Dewberry | |
| 6,678,959 | B1 | | 1/2004 | Phillip et al. | |
| 6,719,504 | B2 | | 4/2004 | Downey | |
| 7,033,259 | B1 | * | 4/2006 | Seasholtz et al. | 451/354 |
| 7,223,163 | B2 | * | 5/2007 | Neumeier et al. | 451/451 |
| 7,232,280 | B2 | | 6/2007 | Bernardi et al. | |
| 7,300,339 | B2 | * | 11/2007 | Gaul et al. | 451/451 |
| 7,364,500 | B2 | * | 4/2008 | Brown | 451/523 |
| 7,980,924 | B2 | * | 7/2011 | Blatz | 451/456 |
| 8,011,357 | B2 | * | 9/2011 | Johansson | 30/124 |

(Continued)

FOREIGN PATENT DOCUMENTS

| | | | | |
|---|---|---|---|---|
| GB | 2131861 | * | 11/1982 | B24B 55/06 |

*Primary Examiner* — Lee D Wilson
*Assistant Examiner* — Henry Hong
(74) *Attorney, Agent, or Firm* — Kriegsman & Kriegsman

(57) ABSTRACT

A grout removal tool includes a cover shaped to define a substantially enclosed interior cavity and a grinding assembly designed to simultaneously abrade grout from multiple, non-linear tile joints. The grinding assembly includes a motor-driven shaft that is rotatably coupled to the cover by a pair of ball bearings. The grinding assembly additionally includes two or more grinding elements that are axially mounted on the shaft in a spaced apart relationship, each grinding element including at least one disc-shaped grinding wheel. A vacuum attachment is externally mounted on the cover and is in communication with the interior cavity through a plurality of circular openings formed in the cover in direct alignment with the grinding elements. One end of the vacuum attachment is preferably connected to a vacuum device that forcibly withdraws and contains debris created during the grout grinding process.

14 Claims, 5 Drawing Sheets

(56) References Cited

U.S. PATENT DOCUMENTS

2002/0174913 A1 11/2002 Johansson
2003/0224707 A1 12/2003 Segiel, Jr.
2004/0159315 A1* 8/2004 Howard et al. ..... 125/13.01
2004/0192181 A1* 9/2004 Bohne et al. ..... 451/451
2012/0090277 A1* 4/2012 Martheenal ..... 53/474

* cited by examiner

TOOL FOR REMOVING GROUT, MORTAR AND THE LIKE

BACKGROUND OF THE INVENTION

The present invention relates generally to tools and more particularly to tools designed to remove grout, mortar and the like.

Grout is a thin mortar that is commonly filled into the joints, or voids, between tiles, bricks and the like. Initially, grout is applied as a wet, cement-based mixture. After the mixture dries and hardens, the resultant material provides both structural support as well as an aesthetic contrast in color and texture to adjacent tiles, which is highly desirable.

Over time, the grout disposed within the joints between tiles tends to soften, loosen and/or discolor. In particular, it has been found that grout in the flooring of commercial kitchens becomes problematic over a brief period of time due to its frequent exposure to foot traffic, industrial cleaners and foods with high salt content.

Because most types of tile tend to preserve their original appearance over time and are expensive to replace, it is well known in the art to restore tiled flooring by simply removing the undesirable grout from its associated joints. Once all the undesirable grout has been removed, new grout is disposed in its place to provide the flooring with a restored appearance.

Handheld grout removal tools, or grout saws, are well known in the art. One well known type of handheld grout removal tool includes an elongated cylindrical stem with a generally tubular handle mounted on one end and a triangular sharpened blade mounted on the opposite end. Grasping the handle, the operator manually grinds, or abrades, the sharpened blade against the undesirable grout using a linear sawing motion until the entirety of the undesirable grout is removed from the tile joint.

As can be appreciated, handheld grout removal tools of the type described above suffer from a notable shortcoming. Specifically, handheld grout removal tools are both labor intensive and physically demanding to use. In particular, the use of handheld tools to manually remove grout from larger flooring areas requires a considerable amount of time and effort to complete.

Accordingly, grout removal power tools are commonly used in the art to accelerate the process of removing grout from the joints between tiles. As defined herein, use of the term "grout removal power tools" encompasses both power tools that are specifically designed to remove grout as well as grout removal adaptors that can be attached to traditional power tools. One well known type of grout removal tool includes a single, removable grinding element, such as a grinding wheel, that is fixedly mounted on an elongated shaft that is, in turn, rotatably driven by a motor. In use, grout removal power tools of the type as described above can be used in the following manner to remove grout from tile joints. Specifically, the power tool is positioned such that the abrasive contact surface of the grinding element is disposed in linear alignment with a tile joint. With power applied to the tool such that the grinding element rotates, a slight downward force is applied onto the tool so that the grinding element abrades the undesirable grout from the joint. While maintaining the abrasive contact surface of the grinding element within the joint, the tool can be displaced linearly along a path of co-linear joints so as to remove all grout disposed therein. Once the linear path of grout has been removed, the tool is lifted and placed into alignment within another path of co-linear tile joints. The process is repeated until all the undesirable grout has been removed from the flooring surface.

Although well known and widely used in the art, grout removal power tools often suffer from a couple notable shortcomings.

As a first shortcoming, grout removal power tools are still somewhat limited in the efficiency in which they can be used to remove grout from an enlarged flooring surface. Specifically, as noted above, grout removal power tools are designed to grind grout along a single path of co-linear tile joints. As a result, the tool must be repeatedly lifted, repositioned and drawn along multiple paths in order to grind out the grout for an entire floor. As can be appreciated, this limitation compromises the efficiency in which a grout removal power tool can be used to remove grout in a larger commercial settings.

As a second shortcoming, grout removal power tools often create and spread a considerable amount of dust and debris during the grinding process. As can be appreciated, this creation of airborne contaminants often creates problems for environments that require a high level of cleanliness, such as commercial kitchens.

SUMMARY OF THE INVENTION

It is an object of the present invention to provide a novel tool for removing grout, mortar and the like from a surface.

It is another object of the present invention to provide a tool as described above which efficiently grinds grout, mortar and the like from a surface.

It is yet another object of the present invention to provide a tool as described above which limits the amount of airborne contaminants spread during the process of grinding grout.

It is yet still another object of the present invention to provide a tool as described above which has a limited number of parts, is inexpensive to manufacture and is easy to use.

Therefore, according to one feature of the present invention, there is provided a tool for removing grout, mortar and the like, the tool comprising (a) a cover shaped to define a substantially enclosed interior cavity, (b) a grinding assembly coupled to the cover, the grinding assembly comprising, (i) a main shaft rotatably coupled to the cover, (ii) a first grinding element axially mounted on the main shaft, and (iii) a second grinding element axially mounted on the main shaft in a spaced apart relationship relative to the first grinding element, (iv) wherein at least a portion of each of the first and second grinding elements is located within the interior cavity of the cover.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 2(*b*) is a section view of the tool shown in FIG. 2(*a*) taken along lines 2B-2B;

FIG. 2(*c*) is a right side view of the tool shown in FIG. 1;

DETAILED DESCRIPTION OF THE PREFERRED EMBODIMENT

Figure 1:
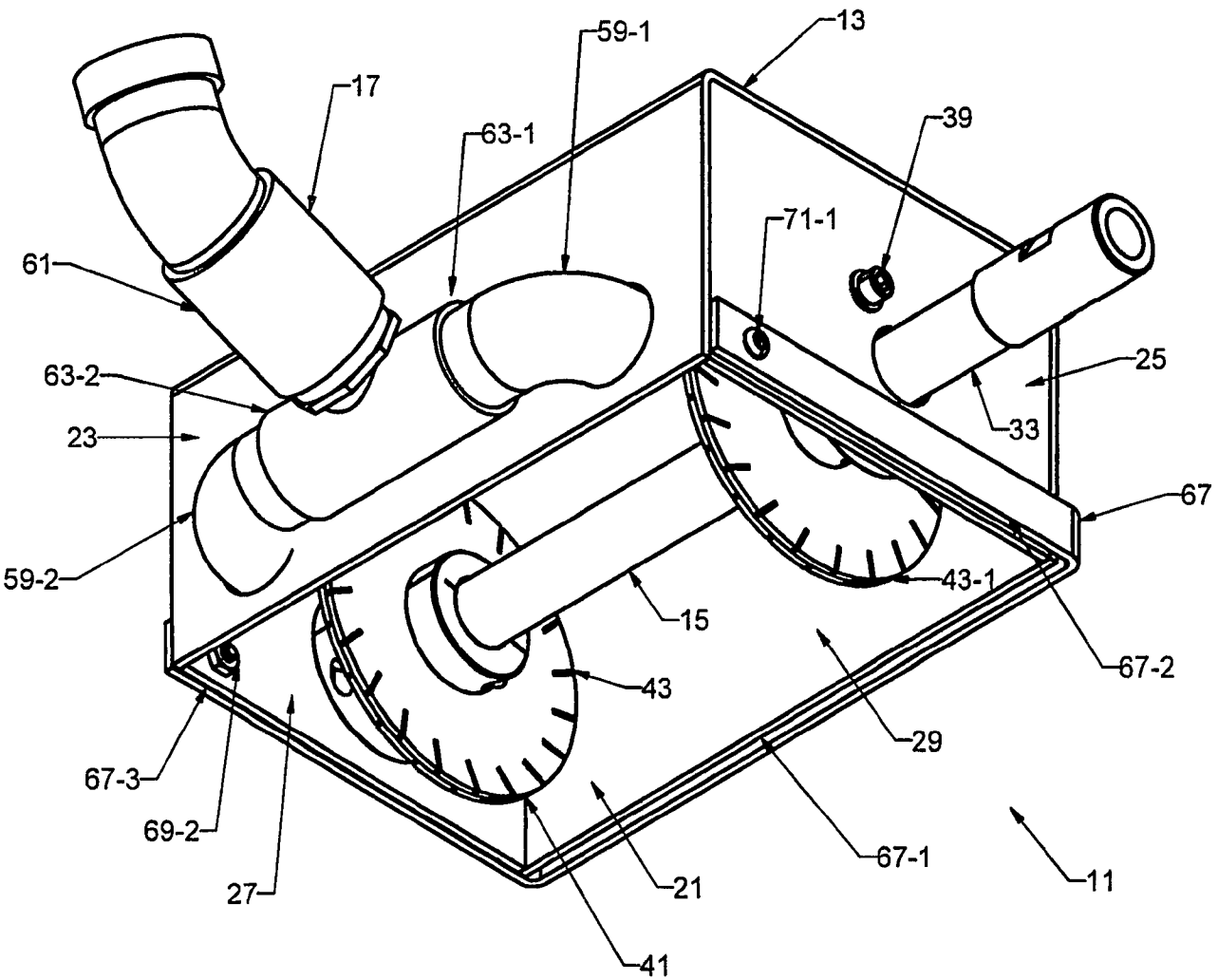
FIG. 1 is a bottom perspective view of a tool for removing grout, mortar and the like, the tool being constructed according to the teachings of the present invention.
Figure 2:
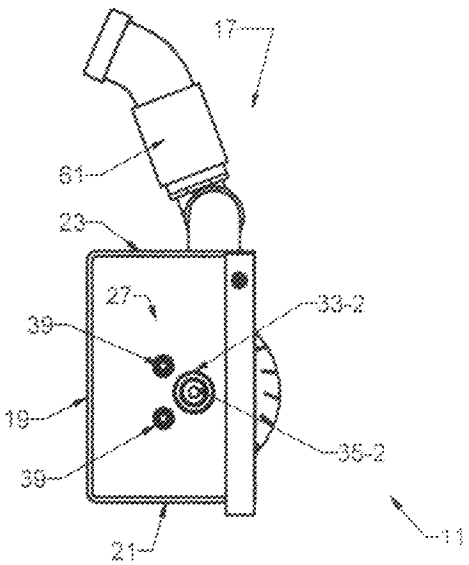
FIG. 2(*a*) is a top plan view of the tool shown in FIG. 1.
Figure 2:
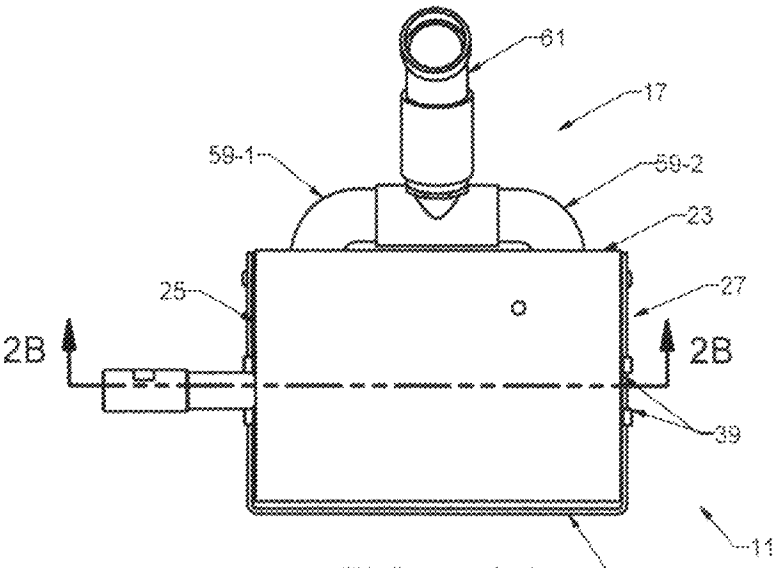
Figure 2:
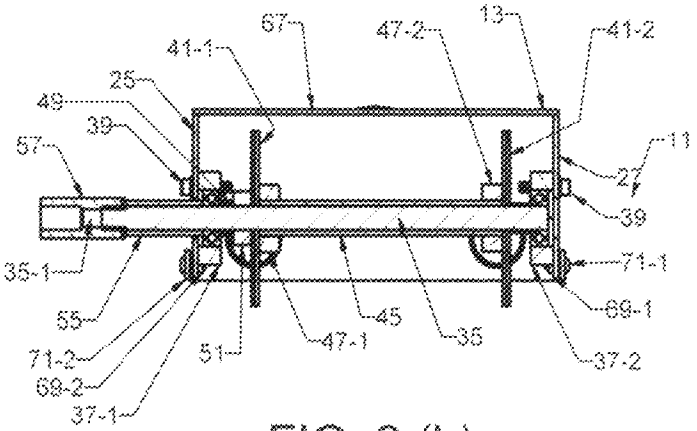

Referring now to FIGS. 1 and 2(*a*)-2(*c*), there is shown a tool for removing grout, mortar and the like from tile joints, the tool being constructed according to the teachings of the present invention and identified generally by reference numeral 11. As will be described further in detail below, tool 11 is designed to simultaneously grind grout disposed in a plurality of separate, non-linear tile joints, thereby significantly accelerating the grout removal process for an enlarged flooring surface, which is highly desirable.

For simplicity purposes only, tool 11 is described herein for use in conjunction with the removal of grout from tile joints. However, it should be noted that tool 11 is not limited to the sole application of removing grout from tile joints. Rather, it is to be understood that tool 11 could be used in other similar applications for removing hardened material from joints (e.g., in masonry applications) without departing from the spirit of the present invention. Accordingly, as defined herein, use of the term "grout" denotes any well known type of joint filling mixture.

As can be seen, tool 11 comprises a protective cover 13, a grinding assembly 15 rotatably mounted onto cover 13 for grinding grout located in multiple non-linear tile joints, and a vacuum attachment 17 fixedly coupled to cover 13 for facilitating removal of debris created by grinding assembly 15 during the grinding process.

Figure 3:
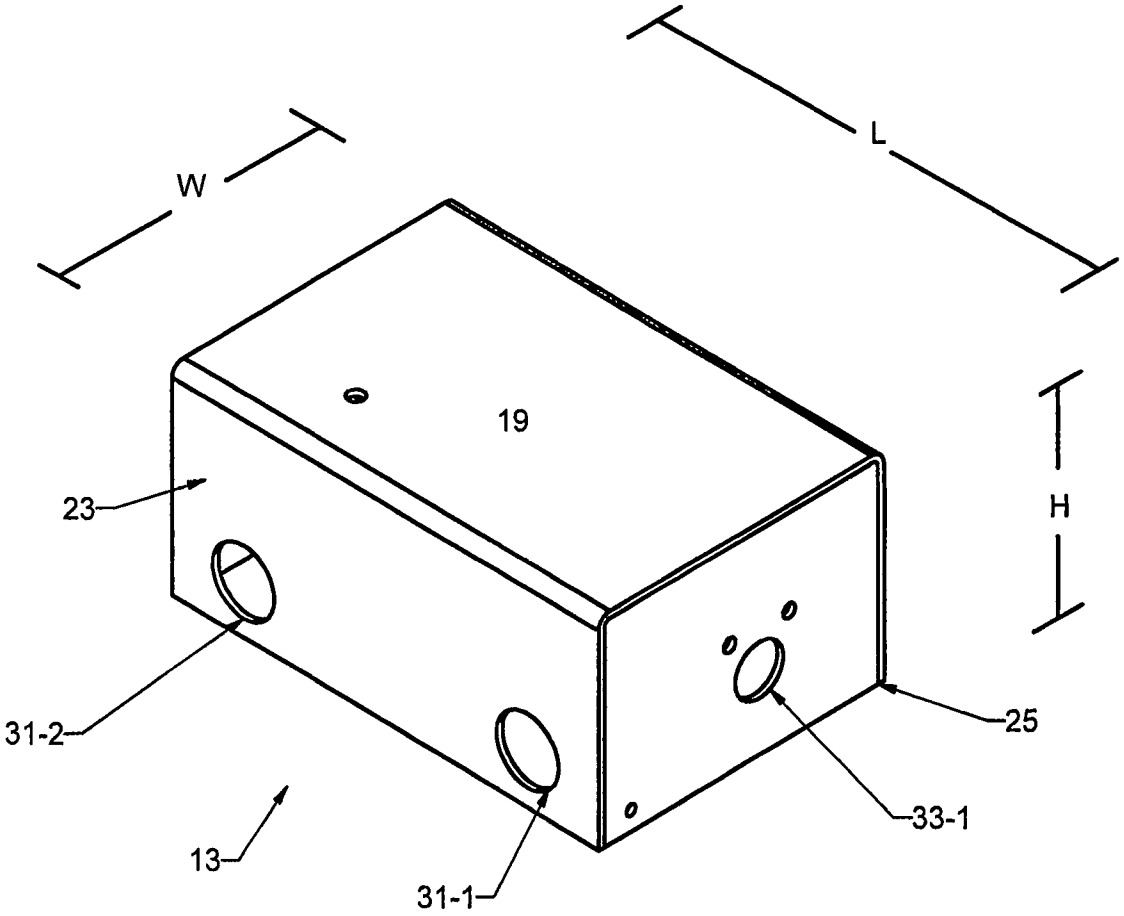
FIG. 3 is a top perspective view of the cover shown in FIG. 1.

As seen most clearly in FIGS. 1-3, protective cover 13 is formed as a unitary, rectangular, box-shaped shroud that is preferably constructed from a rigid and durable material, such as stainless steel. Cover 13 has a five-sided design that includes a top wall 19, a front wall 21, a rear wall 23, a left side wall 25 and a right side wall 27. The bottom of cover 13 is open, thereby providing access to an hollowed interior cavity 29.

Cover 13 is represented herein as having a length L of approximately 9 inches, a width W of approximately 6 inches and a height H of approximately 4 inches. However, it should be noted that cover 13 is not limited to the size and shape set forth above. Rather, it is to be understood that the particular configuration and dimensions of cover 13 could be modified without departing from the spirit of the present invention.

A pair of circular vacuum openings 31-1 and 31-2 are formed in rear wall 23 in a spaced apart relationship. As will be described further below, openings 31 provide externally-mounted vacuum attachment 17 with access to interior cavity 29.

In addition, first and second mounting holes 33-1 and 33-2 are formed in left and right side walls 25 and 27, respectively. As will be described further below, holes 33 are dimensioned to receive a portion of rotatably mounted grinding assembly 15.

Referring now to FIGS. 1, 2(*a*)-(*c*) and 4, grinding assembly 15 comprises a main shaft, or axle, 35 that is rotatably coupled to cover 13. Main shaft 35 is preferably in the form of an elongated rod with an outer diameter of approximately 0.625 inches. As will be described further below, shaft 35 serves as an axial support on which a plurality of components are mounted in a compressed, side-by-side manner to prevent displacement. To facilitate the mounting of components, shaft 35 is preferably externally threaded along at least a portion of its length.

As noted above, main shaft 35 is rotatably coupled to cover 13. Specifically, main shaft 35 includes first and second ends 35-1 and 35-2 that align within mounting holes 33-1 and 33-2, respectively, in cover 13. First and second double-sealed ball bearings 37-1 and 37-2 are fixedly mounted onto the interior surface of left and right side walls 25 and 27, respectively, by screws 39. Each ball bearing 37 is adapted to receive a portion of shaft 35 and thereby allow for axial rotation of shaft 35 relative to cover 13.

Figure 4:
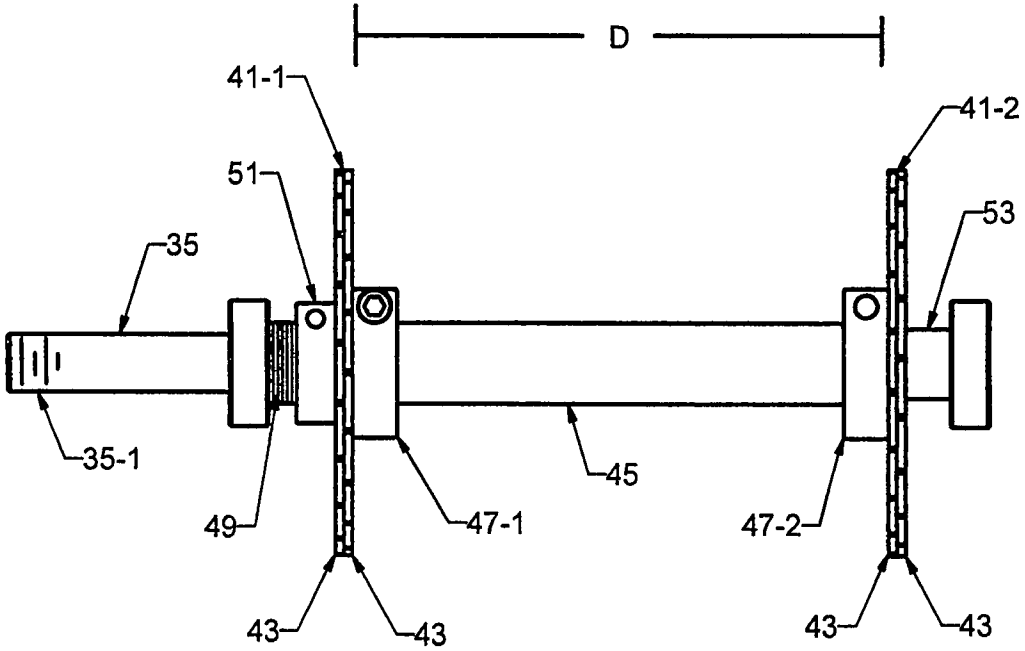
FIG. 4 is a front plan view of selected components of the grinding assembly shown in FIG. 1.
Figure 5:
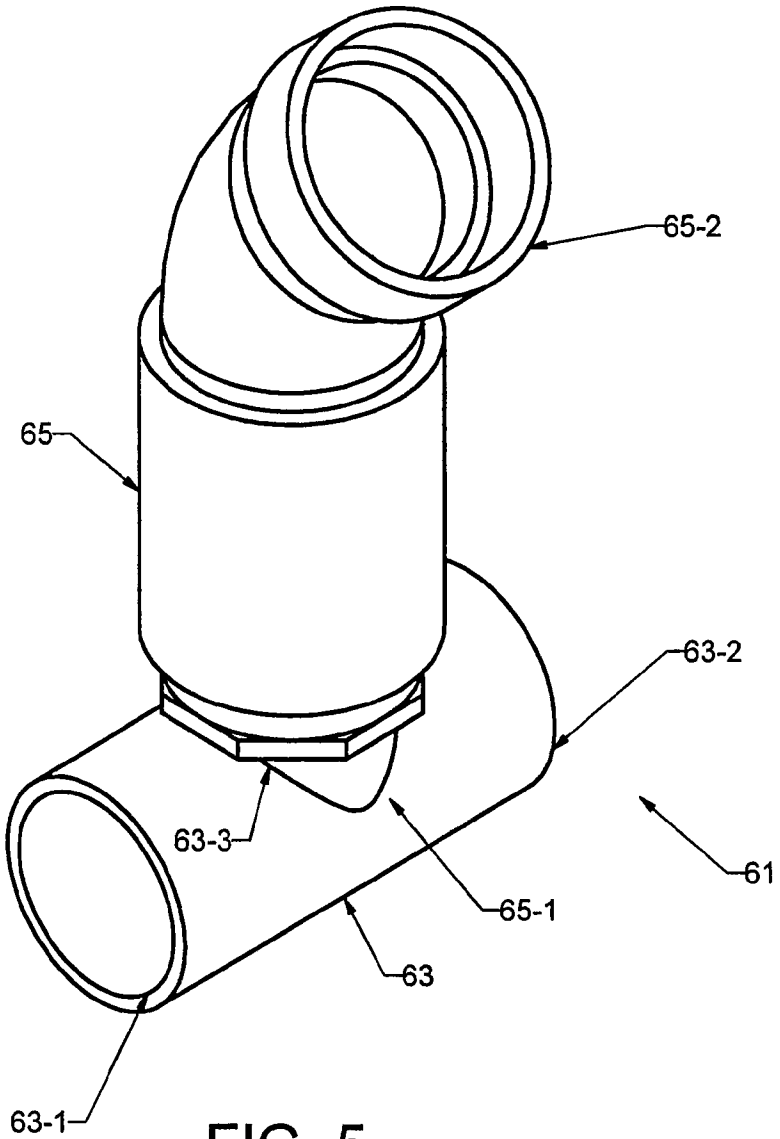
FIG. 5 is an enlarged, top perspective view of the vacuum coupling shown in FIG. 1.

As seen most clearly in FIG. 4, first and second grinding elements 41-1 and 41-2 are axially mounted on main shaft 35 in a spaced apart relationship. As will be described further below, grinding elements 41 are preferably spaced apart from one another a distance that corresponds to the width of each tile on the flooring on which tool 11 is to be used. In this capacity, each grinding element 41 is disposed to align properly within a corresponding tile joint in the flooring. As a consequence, tool 11 can be used to simultaneously abrade the grout disposed within multiple non-linear tile joints, which is a principal object of the present invention.

Grinding elements 41 are represented herein as being spaced apart a fixed distance D of approximately six inches (i.e., the width of a common kitchen tile). However, it is to be understood that, as a feature of the present invention, the spacing between grinding elements 41 could be increased or decreased to accommodate floorings with tiles of different widths without departing from the spirit of the present invention (i.e., by moving grinding elements 41 towards or away from one another on shaft 35).

Each grinding element 41 comprises a pair of disc-shaped grinding wheels 43 that are held firmly together in a front-to-back relationship. Each grinding wheel 43 has an outer diameter of preferably four inches and includes an abrasive outer surface 43-1 that is adapted to grind hardened grout or other similar materials. For example, each grinding wheel 43 may be in the form of a dry cut diamond saw blade.

It should be noted that a pair of grinding wheels 43 are stacked together to provide each grinding element 41 with a grinding width that is approximately the same width of the tile joint in the intended flooring. Accordingly, it is to be understood that the number of stacked grinding wheels 43 could be increased or decreased, as deemed necessary, to accommodate tile joints of different widths without departing from the spirit of the present invention.

A steel spacer 45 is axially mounted onto main shaft 35 between grinding elements 41. Spacer 45 is preferably six inches in length and functions principally to maintain grinding elements 41 the proper distance apart from one another. It is to be understood that spacers of alternative lengths could be used in place of spacer 45 to adjust the distance between grinding elements 41.

A pair of 0.875 inch inner diameter, single split collars 47-1 and 47-2 are mounted on opposite ends of spacer 45. As can be appreciated, tightening of collars 47 serves to fixedly secure spacer 45 in place on main shaft 35.

A brass shim washer 49 and a 0.625 inch inner diameter single split collar 51 are axially mounted on main shaft 35 in a side-by-side fitted relationship between first bearing 37-1 and first grinding element 41-1. Similarly, a bronze bushing 53 is axially mounted on main shaft 35 in a fitted relationship between grinding element 41-2 and bearing 37-2. As can be appreciated, all of the components that are mounted onto main shaft 35 (i.e., grinding wheels 43, spacer 45, washer 49, collar 51 and bushing 53) are compressed firmly against one another in a front-to-back relationship to fixedly retain grinding elements 41 in place on main shaft 35.

As seen most clearly in FIG. 2(*b*), first end 35-1 of main shaft 35 extends through mounting hole 33 and protrudes out from cover 13. A tubular sheath 55 is mounted on the portion of main shaft 35 that extends out from cover 13, sheath 55 being externally threaded at its free end. In addition, an internally threaded brass coupling 57 is mounted onto the free end of sheath 55 in threaded engagement therewith. As can be appreciated, coupling 57 serves as an adapter that enables grinding assembly 15 to be removably coupled to a complementary power tool (not shown), such as a four inch grinder. In this manner, activation of the power tool serves to rotatably drive main shaft 35 which, in turn, serves to rotate grinding elements 41 against the grout that is to be abraded.

Referring now to FIGS. 1, 2(*a*)-2(*c*) and 5, vacuum attachment 17 comprises a pair of drain pipes 59-1 and 59-2 coupled to rear wall 23 of cover 13 and a T-shaped coupling 61 mounted onto the free ends of drain pipes 59.

Each drain pipe 59 is in the form of a shortened, arcuate tube that is preferably constructed of a rigid and durable metal material, such as stainless steel. One end of each drain pipe 59 is permanently connected to the exterior surface of rear wall 23 over a corresponding vacuum opening 31 (e.g., by welding). Accordingly, it is to be understood that each external drain pipe 59 is provided with access to interior cavity 29 through openings 31.

As a feature of the present invention, each opening 31 in cover 13 is preferably located in direct alignment with a corresponding grinding element 41. As a result, debris created by each grinding element 41 during operation of tool 11 can be efficiently extracted from interior cavity 29 through openings 31 by vacuum attachment 17, which is highly desirable.

T-shaped coupling 61 is preferably constructed of a rigid and durable material, such as polyvinyl chloride (PVC) and includes a cross-member 63 connected to drain pipes 59 and an arm, or handle, 65 that orthogonally extends from cross-member 63.

Cross-member 63 is in the form of a shortened length of PVC tubing that includes first and second open ends 63-1 and 63-2. First open end 63-1 of cross-member 63 is connected to the free end of drain pipe 59-1. Similarly, second open end 63-2 of cross-member 63 is connected to the free end of drain pipe 59-2.

Handle 65 is in the form of an extended, partially curved length of PVC tubing that includes an open first end 65-1 and an open second end 65-2. First end 65-1 of handle 65 is coupled to a threaded opening 63-3 formed between first and second ends 63-1 and 63-2 of cross-member 63. Second end 65-2 of handle 65 is preferably adapted to receive a mating adaptor for a vacuum device (not shown).

Accordingly, with a vacuum device coupled to second end 65-2 of handle 65, tool 11 is designed such that debris generated by grinding wheels 43 is forcibly drawn out through vacuum openings 31, through drain pipes 59, out through second end 65-2 of handle 65 and into the vacuum device. In this capacity, tool 11 is specifically designed to minimize the amount of dust, debris and other similar contaminants that is spread in the immediate site of the flooring restoration. As can be appreciated, the ability to limit the amount of such contaminants is critical when re-grouting is required in relatively clean environments, such as commercial kitchens.

It should be noted that arm 65 may be used by the operator as a handle for displacing tool 11. However, it is to be understood that alternative means for moving tool 11 could be achieved without departing from the spirit of the present invention. For example, it is to be understood that a separate, U-shaped handle could be attached to top wall 19 of cover 13 by any conventional securement means (e.g., screws, suction devices, etc.) without departing from the spirit of the present invention.

Referring back to FIG. 1, a narrow, generally U-shaped guard bar 67 is shown pivotally secured to cover 13. Guard bar 67 is formed as a unitary member that is constructed of a rigid and durable material, such as stainless steel. Guard bar 67 has a uniform, rectangular shape in transverse cross-section and includes a front, central portion 67-1 and a pair side portions, or ends, 67-2 and 67-3 that extend rearwardly at a right angle from opposite ends of central portion 67-1.

As noted above, guard bar 67 is pivotally secured to cover 13. Specifically, end 67-2 of guard bar 67 is pivotally secured to the outer surface of left side wall 25 towards its rear edge by the complementary fastening pair of a nut 69-1 and a screw 71-1. Similarly, end 67-3 of guard bar 67 is pivotally secured to the outer surface of right side wall 27 by the complementary fastening pair of a nut 69-2 and a screw 71-2.

As can be appreciated, central portion 67-1 of guard bar 67 can be pivoted downward such that its bottom edge extends below the bottom edge of front wall 21. With guard bar 67 positioned as such and with nuts 69 and screws 71 fastened securely together to hold guard bar 67 fixed in place, it is to be understood that guard bar 67 functions as a depth gauge. Specifically, guard bar 67 extends transversely across the top surface of a tile and, as such, limits the depth that grinding wheels 43 can abrade the grout disposed on opposite sides of said tile.

In view of the description set forth above, it is to be understood that tool 11 can be used in the following manner to abrade grout disposed within multiple, non-linear tile joints. First, a series of set-up steps are undertaken to prepare tool 11 for use. Specifically, tool 11 is prepared for use by: (1) accurately spacing and securing grinding elements 41 the proper distance D apart for use on the intended flooring, (2) adjusting guard bar 67 to the desired grinding depth, (3) connecting the proper component of a vacuum device (not shown) to second end 65-2 of handle 65, and (4) coupling the proper component of a motor-driven grinding tool (not shown) to brass coupling 57.

Having completed the preparatory steps, tool 11 is ready for use in abrading grout disposed within a pair of spaced apart tile joints. Accordingly, tool 11 is positioned such that the abrasive contact surface for each of the pair of spaced apart grinding elements 41-1 and 41-2 is disposed in proper alignment directly above a corresponding tile joint. As noted briefly above, the application of power to the grinding tool drives grinding assembly 15. With main shaft 35 spinning, grinding wheels 43 are drawn firmly against the grout within the tile joints through the application of a suitable downward force onto tool 11. In this manner, grinding wheels 43 serve to simultaneously abrade grout located within the two separate tile joints, which is highly desirable. Continued application of a downward force onto tool 11 increases the depth of the grout abrasion until guard 67 contacts the tile disposed between joints, thereby precluding further grinding.

At this time, tool 11 is drawn along a linear path with constant downward pressure to abrade the entire length of each tile joint. Assuming each tile joint extends into additional co-linear tile joints, tool 11 can be used to grind grout along each co-linear set of tile joints without stopping to lift and reposition the machine. As can be appreciated, because tool 11 includes a pair grinding elements 41 that are spaced apart the width of a tile, it is to be understood that tool 11 can be used to remove grout from a flooring surface at twice the speed as a conventional, single wheel, grout removal power tool. Furthermore, it is to be understood that if additional grinding elements 41 were mounted onto shaft 35, the resultant tool would allow for grout removal from a flooring surface at an even faster rate.

The embodiment shown in the present invention is intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A tool for removing a joint filling mixture, such as grout or mortar, the tool comprising:

(a) a cover comprising a top wall, a front wall having a bottom edge, a rear wall, a left side wall and a right side wall that together are shaped to define no more than a single substantially enclosed interior cavity, wherein the cover is shaped to define a pair of vacuum openings in its rear wall in a spaced apart relationship, (b) a grinding assembly coupled to the cover, the grinding assembly comprising, (i) a main shaft rotatably coupled to the cover and extending transversely through the substantially enclosed interior cavity, (ii) a first grinding element axially mounted on the main shaft in direct alignment with one of the pair of vacuum openings in the cover, and (iii) a second grinding element axially mounted on the main shaft in a spaced apart relationship relative to the first grinding element and in direct alignment with the other of the pair of vacuum openings in the cover, (iv) wherein at least a portion of each of the first and second grinding elements is located within the interior cavity of the cover, (c) a vacuum attachment mounted onto the cover over the pair of vacuum openings, the vacuum attachment being disposed in direct fluid communication with the interior cavity, and (d) a guard bar for limiting the grinding depth attainable by the grinding elements, the guard bar having a bottom edge, the guard bar being pivotally coupled to the cover and adapted for displacement between a first position in which the bottom edge of the guard bar lies flush with the bottom edge of the front wall of the housing and a second position in which the bottom edge of the guard bar lies beneath the bottom edge of the front wall of the housing.

2. The tool as claimed in claim 1 wherein the first grinding element is repositionable on the main shaft relative to the second grinding element in order to adjust the relative spacing therebetween.

3. The tool as claimed in claim 1 wherein the cover is formed as a unitary, rectangular, box-shaped shroud that is constructed out of a rigid and durable metallic material.

4. The tool as claimed in claim 1 wherein the main shaft extends transversely within the interior cavity of the cover and is rotatably coupled to the left and right side walls.

5. The tool as claimed in claim 4 further comprising a first ball bearing fixedly mounted onto the interior surface of the left side wall and a second ball bearing fixedly mounted onto the interior surface of the right side wall, each of the first and second ball bearings rotatably receiving the main shaft.

6. The tool as claimed in claim 4 wherein each grinding element comprises a first disc-shaped grinding wheel that is axially mounted on the main shaft.

7. The tool as claimed in claim 6 wherein each grinding element additionally comprises a second disc-shaped grinding wheel that is axially mounted on the main shaft, the first and second grinding wheels being stacked together in a front-to-back relationship.

8. The tool as claimed in claim 4 further comprising a spacer axially mounted on the main shaft for separating the grinding elements a fixed distance apart from one another.

9. The tool as claimed in claim 8 further comprising means for retaining each grinding element fixed in place on the main shaft.

10. The tool as claimed in claim 1 wherein the vacuum attachment comprises a pair of drain pipes, each drain pipe having a first end and a second end, the first end of each drain pipe being coupled to the exterior surface of the rear wall over a corresponding vacuum opening.

11. The tool as claimed in claim 10 wherein the vacuum attachment additionally comprises a coupling mounted onto the second ends of the pair of drain pipes, the coupling including a open free end that is adapted to matingly receive an adaptor for a vacuum device.

12. The tool as claimed in claim 1 wherein the guard bar is in the form of an elongated, unitary member that includes a first end, a second end and a central portion disposed between the first and second ends.

13. The tool as claimed in claim 12 wherein each of the first and second ends of the guard bar is pivotally connected to the exterior surface of the cover.

14. The tool as claimed in claim 13 wherein the central portion of the guard bar can be repositioned and held fixed in place relative to the cover.

* * * * *